US006000999A

United States Patent [19]

Endo et al.

[11] Patent Number: 6,000,999

[45] Date of Patent: Dec. 14, 1999

[54] PREPARATORY ABRADING METHOD FOR SUPPORT OF LITHOGRAPHIC PLATE

[75] Inventors: Masahiro Endo; Akio Uesugi, both of Shizuoka, Japan

[73] Assignee: Fuji Photo Film Co., Ltd., Kanagawa, Japan

[21] Appl. No.: 09/267,630

[22] Filed: Mar. 15, 1999

[30] Foreign Application Priority Data

Mar. 13, 1998 [JP] Japan ..... 10-063039

[51] Int. Cl.[6] ..... B24B 7/00

[52] U.S. Cl. ..... 451/28; 451/541; 451/178

[58] Field of Search ..... 428/36.1, 36.3, 428/141, 116, 118, 156, 182, 212; 451/541, 544, 28, 60, 178, 182, 184, 540

[56] References Cited

U.S. PATENT DOCUMENTS 3,720,164 3/1973 Casson, Jr. ..... 101/463
4,049,504 9/1977 Chu et al. ..... 204/38 A
4,524,125 6/1985 Huang ..... 430/302
5,837,345 11/1998 Nishino et al. ..... 428/141

FOREIGN PATENT DOCUMENTS 50-40047 12/1975 Japan ..... G03F 7/00

*Primary Examiner*—Derris Holt Banks
*Attorney, Agent, or Firm*—Sughrue, Mion, Zinn, MacPeak & Seas, PLLC

[57] ABSTRACT

A rotating preparatory abrasion roller finely abrades the surface of a web, which is to be a support of a lithographic plate, in preparatory abrading prior to main graining for graining the surface of the web. The preparatory abrasion roller, which is arranged against one surface of the running web, is pressed into an interval between a pair of supporting rollers, which are arranged at a predetermined interval against the other surface of the web. Consequently, the surface of the web is finely abraded in contact with a relatively large area on the surface of the preparatory abrasion roller in the state wherein the web laps with the part of the preparatory abrasion roller.

12 Claims, 4 Drawing Sheets

PREPARATORY ABRADING METHOD FOR SUPPORT OF LITHOGRAPHIC PLATE

BACKGROUND OF THE INVENTION

1. Field of the Invention

The present invention relates generally to a method for graining the surface of a metal support of a lithographic plate, and more particularly to a preparatory abrading method for the surface of the metal support.

2. Description of Related Art

The surface of a metal web to be a support of a lithographic plate such as a web of aluminum or an alloy of aluminum and zinc is grained so that a fine unevenness called grains can be formed thereon to thereby improve its performance for printing.

Examples of the method for graining the surface of the web are a mechanical graining method using a brush roller (e.g., Japanese Patent Publication No. 50-40047), an electrolytic graining method in which electrolysis is performed in an electrolytic solution, and a chemical graining method in which the web is dipped in a chemical solution.

If, however, the locally-uneven web is grained mechanically, electrolytically or chemically, the uneven part cannot be grained uniformly, which deteriorates the printing performance at the uneven part.

Conventionally, the above-mentioned problem is avoided by preparatory abrasion to the surface of the web with a nonwoven fabric prior to the above-mentioned main graining; however, lateral defects and longitudinal streaks are formed on the web in the conventional preparatory abrasion.

SUMMARY OF THE INVENTION

The present invention has been developed in view of the above-described circumstances, and has as its object the provision of the preparatory abrading method for the support of the lithographic plate, in which the web is finely abraded without forming the lateral defects and longitudinal streaks on the surface thereof during the preparatory abrasion using the preparatory abrasion roller provided with the nonwoven fabric so that the support of the lithographic plate can become uniformly grained as a result of the main graining.

To achieve the above-mentioned object, the present invention is directed to a preparatory abrading method for preliminarily abrading a surface of a metal web to be a support of a lithographic plate prior to a main graining wherein the surface of the web is grained, the preparatory abrading method comprising the step of: finely abrading the surface of the web by a rotating preparatory abrasion roller provided with nonwoven fabric, a pair of rollers supporting the web, the supporting rollers being arranged with a predetermined interval and facing the preparatory abrasion roller across the web, the preparatory abrasion roller being pressed into the interval between the supporting rollers, such that the surface of the web is finely abraded with the nonwoven fabric of the preparatory abrasion roller in a state wherein the web laps with a part of the preparatory abrasion roller.

According to the present invention, when the surface of the web is finely abraded by the preparatory abrasion roller prior to the main graining for graining the surface of the web, the preparatory abrasion roller, which is arranged against one surface of the running web, is pressed into the interval between the supporting rollers, which are arranged at a predetermined interval against the other surface of the web, so that the web can lap with a part of the preparatory abrasion roller and be in contact with a relatively large area on the preparatory abrasion roller. Consequently, the surface of the web is finely abraded without forming the lateral defects and longitudinal streaks thereon, and the surface of the web becomes grained uniformly as a result of the main graining, which is performed after the preparatory abrasion.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
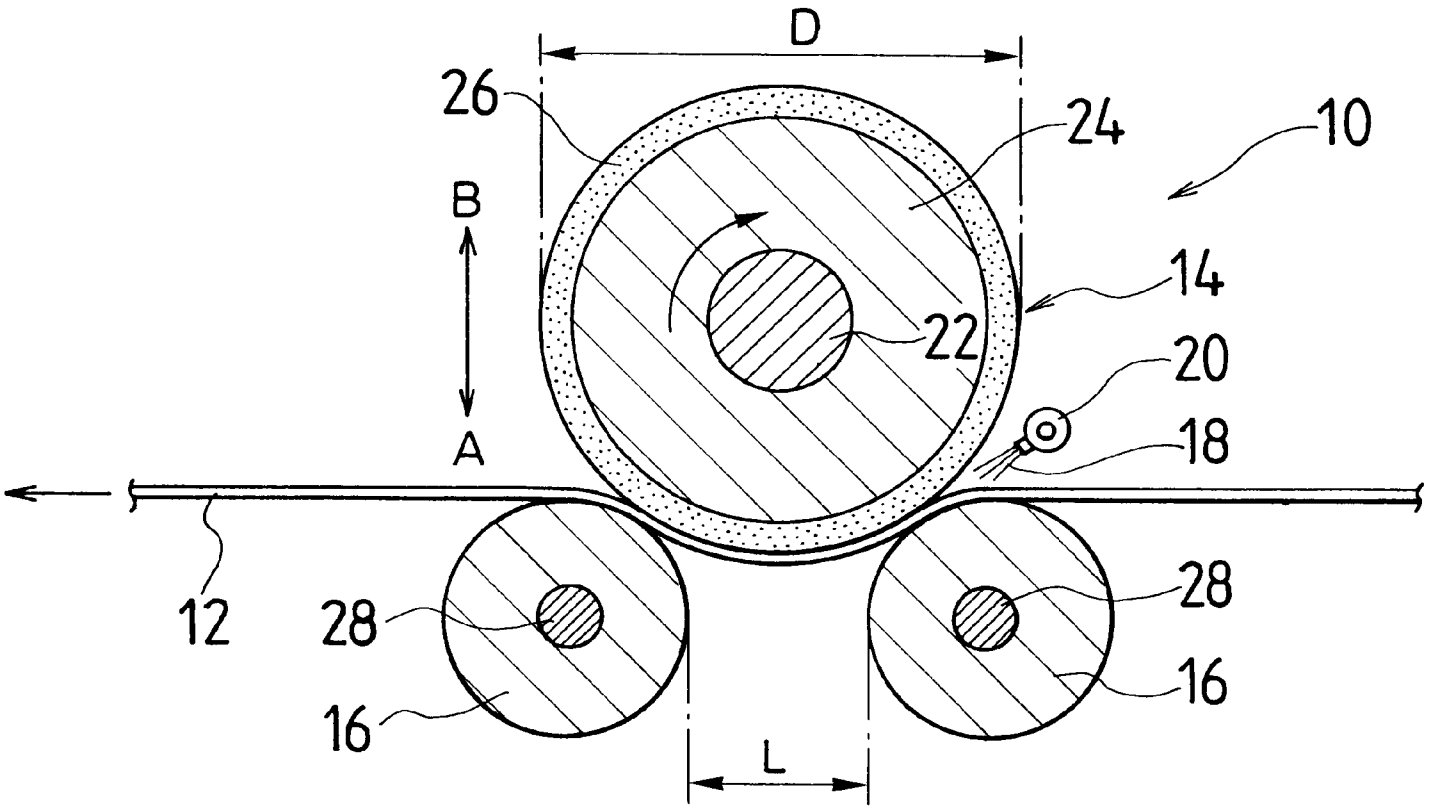
FIG. 1 is a side sectional view illustrating the structure of a preparatory abrading apparatus that is used in a preparatory abrading method according to an embodiment of the present invention.

FIG. 1 shows the overall structure of a preparatory abrading apparatus that is used in a preparatory abrading method according to an embodiment of the present invention.

As shown in FIG. 1, the preparatory abrading apparatus 10 comprises a preparatory abrasion roller 14, which is arranged against one surface of a web 12 to be a support of a lithographic plate made of such as aluminum or an alloy of aluminum and zinc; a pair of supporting rollers 16, which are provided against the other surface of the web 12 to support the web 12; and a nozzle 20 spraying a liquid 18, which is slurry containing particles of abrasive or water, on the surface of the web 12.

The preparatory abrasion roller 14 is constructed in such a way that a cylindrical core member 24 is fixed to a rotary shaft 22, a cylindrical nonwoven fabric 26 is fixed to the circumferential surface of the core member 24, and the rotary shaft 22 connects to a motor (not illustrated). The preparatory abrasion roller 14 is capable of moving upward and downward by 100 mm in directions indicated by an arrow A-B, and it is thus capable of being pressed into an interval between the supporting rollers 16. A variety of nonwoven fabric may be used, and the nonwoven fabric 26 is preferably made of nylon and has a surface hardness of 40 degrees or more when it is used on the preparatory abrasion roller 14.

Each of the supporting rollers 16 is constructed in such a way that a cylindrical hard rubber or a metal cylinder is fixed to a rotary shaft 28. The interval (L) between the supporting rollers 16 is determined so that it can be shorter than the diameter (D) of the preparatory abrasion roller 14. For example, if the diameter (D) of the preparatory abrasion roller 14 is 300 mm and the supporting rollers 16 are 200 mm in diameter, the supporting rollers 16 are preferably arranged with the interval (L) of 100 mm or more and 250 mm or less. The supporting rollers 16 rotate at the same speed as a running speed of the web 12.

The nozzle 20 is arranged at the upstream side of the preparatory abrasion roller 14 in the running direction of the web 12. The nozzle 20 is rectangular along the axis of the preparatory abrasion roller 14. A slurry supply unit (not illustrated) supplies the slurry or water 18 to the nozzle 20. The slurry or the water 18 is sprayed on the surface of the web 12 through the nozzle 20, while the preparatory abrasion roller 14 is rotating in order to finely abrade the surface of the web 12. Examples of the particles of abrasive contained in the slurry are of emery, silica, alumina and silicon carbide.

A description will be given of the operation of the preparatory abrading apparatus 10, which is constructed in the above-mentioned manner.

First, the preparatory abrasion roller 14 is moved in the direction indicated by the arrow B in FIG. 1, and the web 12 is inserted between the preparatory abrasion roller 14 and the supporting rollers 16 in the state wherein the preparatory abrasion roller 14 is apart from the supporting rollers 16. Then, the preparatory abrasion roller 14 is moved in the direction indicated by the arrow A in FIG. 1 in order to bring the preparatory abrasion roller 14 in contact with the supporting rollers 16 across the web 12.

The slurry or the water 18 is sprayed on the surface of the running web 12 while the preparatory abrasion roller 14 is rotating so as to finely abrade the surface of the web 12. During the abrasion, the preparatory abrasion roller 14 is preferably rotated in the running direction of the web 12. Since the preparatory abrasion roller 14 is pressed into the interval between the supporting rollers 16 across the web 12, the abrasion is performed in the state wherein the web 12 laps with a part of the preparatory abrasion roller 14 and is in contact with a relatively large area on the preparatory abrasion roller 14.

After the preparatory abrasion, the finely abraded web 12 runs to a main graining apparatus (not illustrated) such as a mechanical graining apparatus using a brush roller, an electrolytic graining apparatus performing electrolysis in an electrolytic solution, and a chemical graining apparatus dipping the web 12 in a chemical solution. The main graining is performed in the mechanical graining method, the electrolytic graining method or the chemical graining method, or in a combination of these methods.

As stated above, in the preparatory abrading method for the support of the lithographic plate according to the present invention, the rotating preparatory abrasion roller 14 finely abrades the surface of the web 12 in the preparatory abrasion prior to the main graining wherein the surface of the web 12 is grained. In the preparatory abrading method, the preparatory abrasion roller 14, which is arranged against one surface of the running web 12, is pressed into the interval between the supporting rollers 16, which are arranged at the predetermined interval against the other surface of the web 12 to support the web 12, so that the surface of the web 12 can be finely abraded in the state wherein the web 12 laps with a part of the preparatory abrasion roller 14. Consequently, the surface of the web 12 is finely abraded without forming the lateral defects and longitudinal streaks thereon, and the uniformity of the surface of the support of the lithographic plate after the main graining is improved.

In this embodiment, the slurry or water 18 is sprayed on the surface of the web 12 through the nozzle 20, but it is possible to omit the supply of the slurry through the nozzle 20 if the nonwoven fabric 26 of the preparatory abrasion roller 14 contains particles of abrasive. In this case, the cleaning water is sprayed on the surface of the web 12 in order to wash out sludge. Examples of the particles of abrasive contained in the nonwoven fabric 26 are of emery, silica, alumina and silicon carbide.

EXAMPLE

A description will be given of examples of the preparatory abrading method for the support of the lithographic plate according to the present invention and comparative examples.

In the examples, evaluations were made with regard to a relation between the interval between the supporting rollers 16 and the surface quality of the web 12 after the preparatory abrasion. In the evaluations, the lateral defects and longitudinal streaks of the abraded surface of the web 12 were observed with visual inspection.

The interval between the supporting rollers 16 was 100 mm (Embodiment 1), 150 mm (Embodiment 2), 200 mm (Embodiment 3), 250 mm (Embodiment 4) and 300 mm (Embodiment 5).

Figure 2:
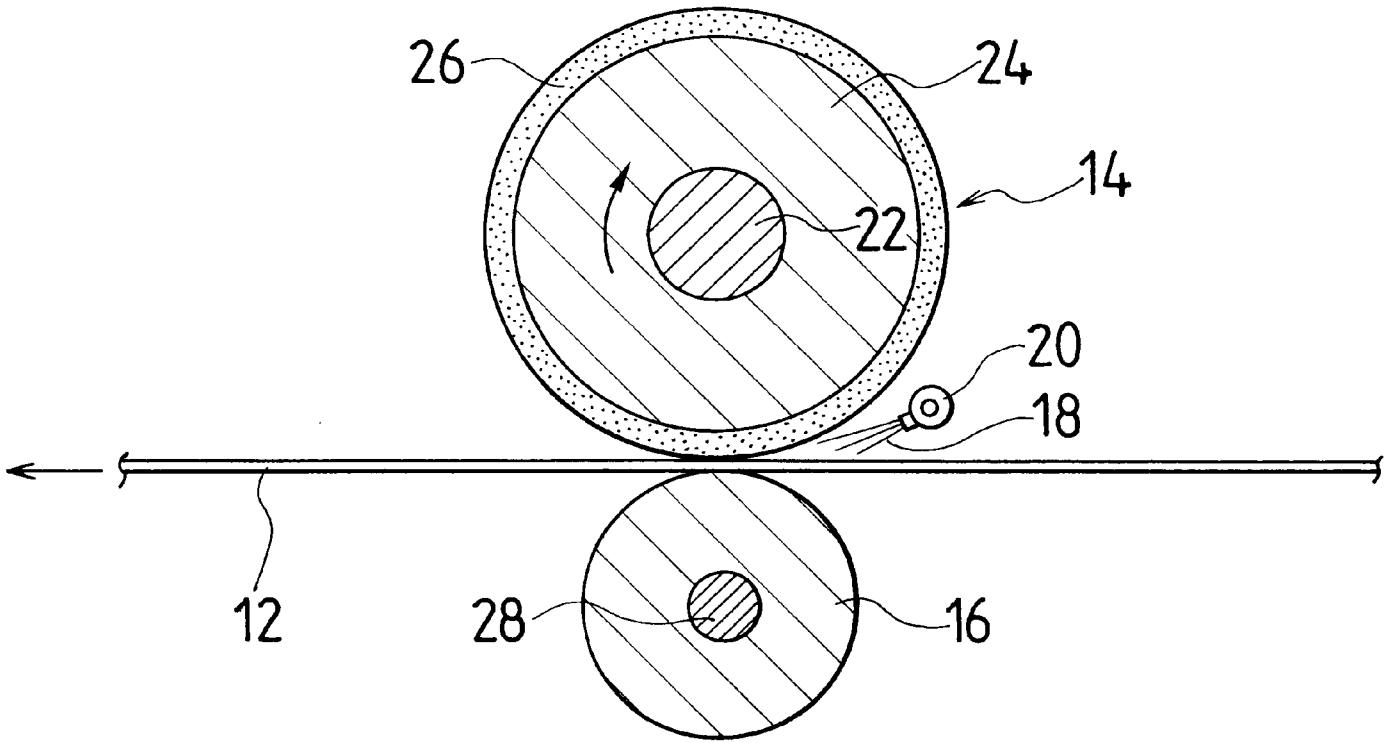
FIG. 2 is a side sectional view illustrating the structure of a preparatory abrading apparatus in a comparative example 1.
Figure 3:
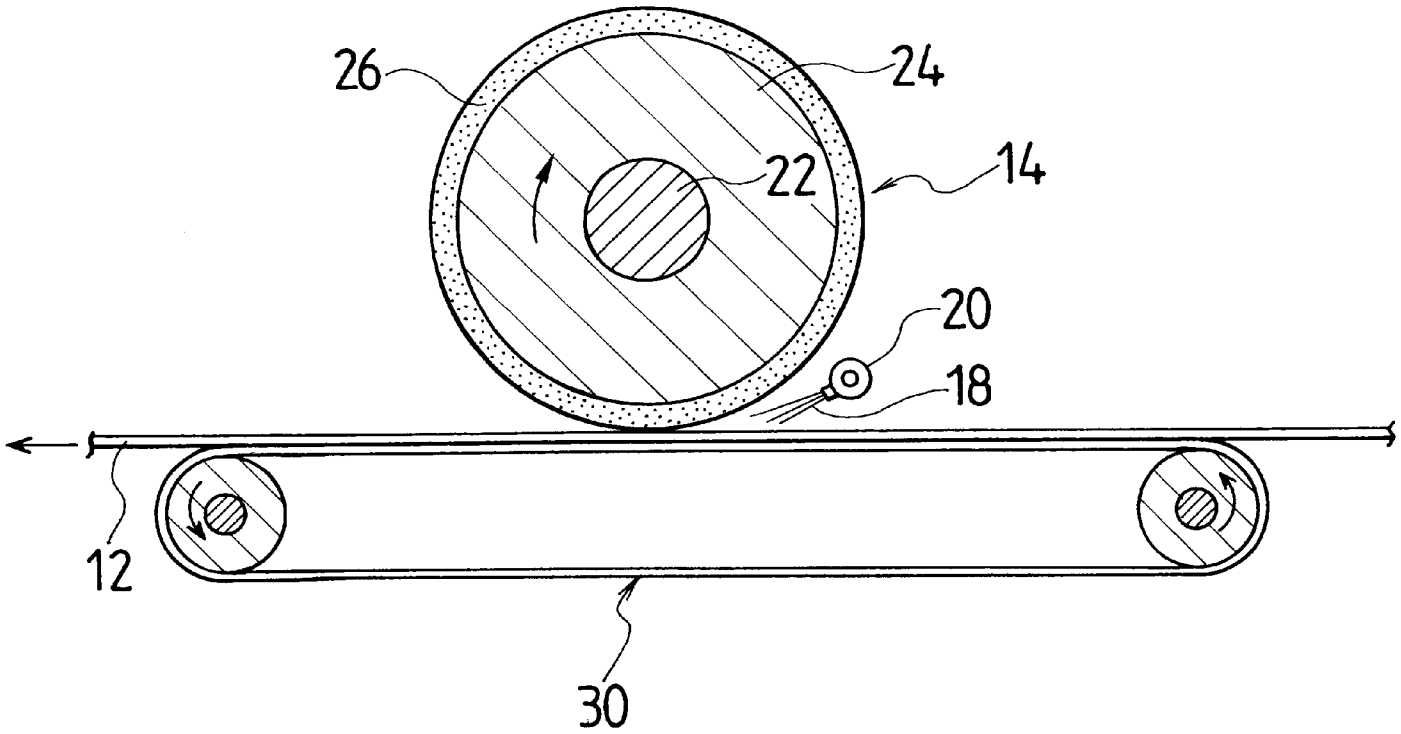
FIG. 3 is a side sectional view illustrating the structure of a preparatory abrading apparatus in a comparative example 2.
Figure 4:
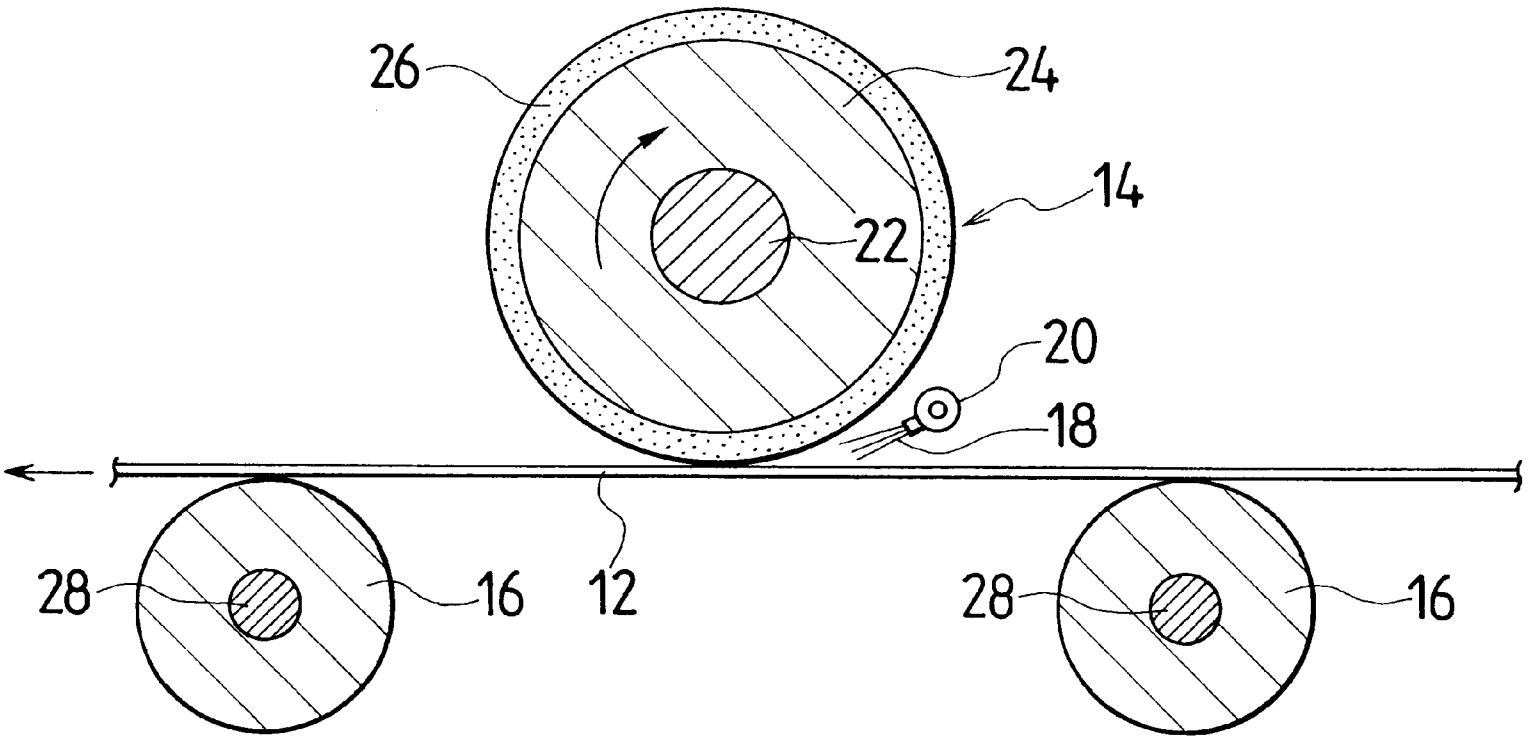
FIG. 4 is a side sectional view illustrating the structure of a preparatory abrading apparatus in comparative examples 3 and 4.

On the other hand, the surface quality of the web 12 was also evaluated in comparative examples 1, 2, 3 and 4. In the comparative example 1, a single supporting roller 16, which supports the web 12, is placed just under the preparatory abrasion roller 14 as shown in FIG. 2. In the comparative example 2, a conveyor belt 30 supports the web 12 as shown in FIG. 3 instead of the supporting roller 16. In the comparative examples 3 and 4, the interval between the supporting rollers 16 was 400 mm and 700 mm, respectively, which were larger than the diameter of the preparatory abrasion roller 14 contrary to the present invention.

The following other conditions were common to all examples: the preparatory abrasion roller 14 was 300 mm in diameter; the supporting roller 16 was 200 mm in diameter; the nonwoven fabric 26 of the preparatory abrasion roller 14 contained particles of silicon carbide of which average size was 10 $\mu$m; the preparatory abrasion roller 14 rotated at a circumferential speed of 1,000 m/min; the web 12 was pressed under the abrasion pressure of +3A/100 mm; the web 12 was an aluminum web with 0.24 mm thickness and 100 mm width, the web 12 was unwound from a reel device (not illustrated) and inserted into the space between the preparatory abrasion roller 14 and the supporting roller(s) 16 or the conveyor belt 30, and the web 12 was transported at a speed of 20 m/min; and the cleaning water 18 was sprayed through the nozzle 20.

TABLE 1

TABLE 1 shows the results in the embodiments 1–5 and the comparative examples 1–4.

| | Number of supporting roller | Interval between supporting rollers [mm] | Surface quality after preparatory abrasion | |
|---|---|---|---|---|
| | | | Lateral defect | Longitudinal streak |
| Embodiment 1 | 2 | 100 | No | No |
| Embodiment 2 | 2 | 150 | No | No |
| Embodiment 3 | 2 | 200 | No | No |
| Embodiment 4 | 2 | 250 | No | No |
| Embodiment 5 | 2 | 300 | Few | Few |
| Comparative ex. 1 | 1 | — | Extremely many | Many |

TABLE 1-continued

TABLE 1 shows the results in the embodiments 1–5 and the comparative examples 1–4.

| | Number of supporting roller | Interval between supporting rollers [mm] | Surface quality after preparatory abrasion | |
|---|---|---|---|---|
| | | | Lateral defect | Longitudinal streak |
| Comparative ex. 2 | (Conveyor) | — | Many | Many |
| Comparative ex. 3 | 2 | 400 | Many | Many |
| Comparative ex. 4 | 2 | 700 | Extremely many | Extremely many |

As is clear from the results of the embodiments 1–4 in TABLE 1, an increase in the interval between the supporting rollers 16 from 100 mm to 250 mm did not cause the lateral defects and longitudinal streaks to be formed on the surface of the web 12, and the favorable abraded surface were acquired. When the interval between the supporting rollers 16 was increased by 300 mm so that it was equal to the diameter of the preparatory abrasion roller 14, few lateral defects and longitudinal streaks were formed on the surface of the web 12 within the permissible level in view of the performance for printing.

Although not shown in TABLE 1, the lateral defects and longitudinal streaks were formed when the interval between the supporting rollers 16 was less than 100 mm. That was because the preparatory abrasion roller 14 was pressed little into the interval between the supporting rollers 16, and hence the contact area of the web 12 with the preparatory abrasion roller 14 was reduced. From the above-mentioned results, it was found that the interval between the supporting rollers 16 should be 100 mm or more and shorter than the diameter of the preparatory abrasion roller 14 in order to maintain the quality of the finely abraded surface of the web 12.

In the comparative example 1, the abraded surface of the web 12 had extremely many lateral defects and many longitudinal streaks thereon. This indicated the following matter. If the single supporting roller 16 is placed just under the preparatory abrasion roller 14, the web 12 is seemingly supported satisfactorily. Actually, the quality of the abraded surface is not favorable due to strong vibrations resulting from strong collisions between the preparatory abrasion roller 14 and the web 12 in front of and behind a point of contact between the supporting roller 16 and the web 12.

In the comparative example 2, the abraded surface of the web 12 had many lateral defects and longitudinal streaks thereon. Although the conveyer 30 seems to stably support the web 12, the lateral defects and longitudinal streaks are formed on the abraded surface since there is no play for absorbing vibrations of the nonwoven fabric 26 of the preparatory abrasion roller 14.

In the comparative example 3, the abraded surface of the web 12 had many lateral defects and longitudinal streaks thereon. In the comparative example 4, the abraded surface of the web 12 had extremely many lateral defects and longitudinal streaks thereon. That is because the web 12 cannot be supported stably if the interval between the supporting rollers 16 is larger than the diameter of the preparatory abrasion roller 14.

As stated above, the surface quality of the web 12 after the preparatory abrasion in the embodiments of the present invention is more excellent than in the comparative examples because the preparatory abrasion roller 14, which is arranged against one surface of the running web 12, is pressed into the interval between the pair of supporting rollers 16, which are arranged at the predetermined interval against the other surface of the web 12 to support the web 12, and therefore the web 12 is supported stably. Moreover, the surface of the web 12 can be finely abraded in contact with the relatively large area on the surface of the preparatory abrasion roller 14 (see FIG. 1) in the state wherein the web 12 laps with the part of the preparatory abrasion roller 14, and hence the preparatory abrasion roller 14 does not strongly collide with the web 12 compared with the comparative example 1 wherein the preparatory abrasion roller 14 is in contact with the web 12 in a line (see FIG. 2). This is proved by the fact that if the interval between the supporting rollers 16 is reduced too much, the surface quality of the web 12 is deteriorated.

As set forth hereinabove, in the preparatory abrading method for the support of the lithographic plate according to the present invention, the surface of the support of the lithographic plate is finely abraded without forming the lateral defects and longitudinal streaks thereon, and the finely abraded surface can be grained uniformly in the main graining after the preparatory abrasion.

It is therefore possible to manufacture the lithographic plate with excellent performance for printing.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A preparatory abrading method for preliminarily abrading a surface of a metal web to be a support of a lithographic plate prior to a main graining wherein the surface of the web is grained, the preparatory abrading method comprising the step of:

finely abrading the surface of the web by a rotating preparatory abrasion roller provided with nonwoven fabric, a pair of rollers supporting the web, the supporting rollers being arranged with a predetermined interval and facing the preparatory abrasion roller across the web, the preparatory abrasion roller being pressed into the interval between the supporting rollers, such that the surface of the web is finely abraded with the nonwoven fabric of the preparatory abrasion roller in a state wherein the web laps with a part of the preparatory abrasion roller.

2. The preparatory abrading method as defined in claim 1, wherein the interval between the supporting rollers is shorter than a diameter of the preparatory abrasion roller.

3. The preparatory abrading method as defined in claim 1, wherein the preparatory abrasion roller is capable of moving upward and downward with respect to the supporting rollers.

4. The preparatory abrading method as defined in claim 1, wherein the abrading step comprises the step of spraying slurry containing particles of abrasive on the surface of the web.

5. The preparatory abrading method as defined in claim 4, wherein an average size of the particles of abrasive contained in the slurry is 5–40 μm.

6. The preparatory abrading method as defined in claim 1, wherein the nonwoven fabric of the preparatory abrasion roller is made of nylon and surface hardness of the nonwoven fabric on the preparatory abrasion roller is 40 degrees or more.

7. The preparatory abrading method as defined in claim 6, wherein an average size of the particles of abrasive contained in the nonwoven fabric is 5–40 μm.

8. The preparatory abrading method as defined in claim 6, wherein:

the abrading step comprises the step of spraying water on the surface of the web; and the nonwoven fabric of the preparatory abrasion roller contains particles of abrasive.

9. The preparatory abrading method as defined in claim 8, wherein an average size of the particles of abrasive contained in the nonwoven fabric is 5–40 μm.

10. The preparatory abrading method as defined in claim 1, wherein:

the abrading step comprises the step of spraying water on the surface of the web; and the nonwoven fabric of the preparatory abrasion roller contains particles of abrasive.

11. The preparatory abrading method as defined in claim 10, wherein an average size of the particles of abrasive contained in the nonwoven fabric is 5–40 μm.

12. The preparatory abrading method as defined in claim 1, wherein the main graining is at least one of a mechanical graining using a brush roller, an electrolytic graining wherein an electrolysis is performed in an electrolytic solution, and a chemical graining wherein the web is dipped in a chemical solution.

* * * * *